US006164092A

United States Patent [19]

Menaker

[11] Patent Number: 6,164,092

[45] Date of Patent: Dec. 26, 2000

[54] KNITTED FABRIC HAVING ELASTOMERIC YARN

[76] Inventor: Peter Menaker, 57 N. Sterling Heights Rd., Vernon Hills, Ill. 60061

[21] Appl. No.: 09/035,254

[22] Filed: Mar. 5, 1998

[51] Int. Cl.[7] ..... D04B 1/18; A47G 9/02

[52] U.S. Cl. ..... 66/170; 66/202; 5/497

[58] Field of Search ..... 66/201, 202, 169 R, 66/170, 171, 194; 5/482, 495, 497, 498, 499

[56] References Cited

U.S. PATENT DOCUMENTS

| | | | |
|---|---|---|---|
| 2,350,359 | 6/1944 | Krasnov et al. | 66/170 |
| 2,624,893 | 1/1953 | Harris | 5/497 |
| 3,638,251 | 2/1972 | Weiss . | |
| 3,789,441 | 2/1974 | Weiss . | |
| 4,213,312 | 7/1980 | Safrit et al. | 66/177 |
| 4,216,662 | 8/1980 | Harris, Jr. et al. | 66/186 |
| 4,308,626 | 1/1982 | Weiss | 5/485 |
| 4,495,233 | 1/1985 | Bassetti . | |
| 4,578,306 | 3/1986 | Heiman . | |
| 4,670,326 | 6/1987 | Heiman . | |
| 4,720,415 | 1/1988 | Vander Wielson et al. . | |
| 4,723,331 | 2/1988 | Weiss | 5/497 |
| 4,724,183 | 2/1988 | Heiman . | |
| 4,801,482 | 1/1989 | Goggans et al. . | |
| 5,029,353 | 7/1991 | Kimball et al. | 5/497 |
| 5,127,115 | 7/1992 | Williams et al. . | |
| 5,287,574 | 2/1994 | Kardell . | |
| 5,530,979 | 7/1996 | Whitley . | |
| 5,603,132 | 2/1997 | Zafiroglu . | |
| 5,765,241 | 6/1998 | Macdonald | 5/497 |

*Primary Examiner*—Danny Worrell
*Attorney, Agent, or Firm*—Law Offices of Royal W. Craig

[57] ABSTRACT

A knitted fabric comprised of two yarn types wherein at least one yarn type is made of an elastomeric fiber and the other yarn type is made of a substantially non-elastic fiber. In the preferred embodiment, one yarn type is a blend of polyester and cotton and the other yarn type is spandex. This overall blend of spandex and poly-cotton fibers creates a knitted fabric having resilience, elasticity and versatility beyond that of a traditional poly-cotton blend fabric. This knitted fabric can then be used to produce sheeting materials, such as fitted contour sheets, which retain shape better, are more easily handled, and have a greater life that standard poly-cotton blend sheets.

8 Claims, 1 Drawing Sheet

KNITTED FABRIC HAVING ELASTOMERIC YARN

BACKGROUND OF THE INVENTION

The present invention relates to an improved knitted fabric, and in particular to a knitted sheeting material made of a poly-cotton yarn and elastomeric yarn which retains its shape, is stretchable, versatile, and longer lasting than cotton/polyester sheets.

Currently, it is known in the art to provide plain woven and knitted sheets to institutions such as hospitals, nursing homes, rest homes and the like. Most commonly, these sheets are woven, rather than knitted, and are made from only a blend of polyester and cotton yarns.

The fitted or contoured sheets made from "conventional" woven fabric generally do not fit more than one mattress size and are difficult to fit on mattresses having foam comfort overlays. Accordingly, institutions using conventional woven contour or fitted sheets must maintain sheets of several sizes in order to fit all the bed sizes within the institution.

Another common problem with conventional woven fitted sheets is that they "pop off" the mattress rather easily. Fitted sheets generally pop off the mattress because they are either too small for the mattress or have difficulty adhering to the mattress when the head or foot of the bed is raised or lowered. A common problem associated with conventional sheets that are knitted from polyester-cotton blend strands is that they have a tendency to wear out over time due to "pinholing." Pinholing results from individual yarns snagging and breaking or from fatigue of fibers due to repeated washing. When the pinholes get too large or too numerous, the sheets are taken out of service. A third problem with conventional woven and knitted contour sheets is shrinkage. After washing they become smaller and thus more difficult to fit over a mattress. The corner seams may rip permanently due to the bedmaking staff having to pull very hard to stretch the sheets onto the mattress. Finally, in institutional settings, these same prior woven or knitted sheets tend to "bunch" from the raising or lowering of the bed or bunch when a patient repositions one's self in the bed. This bunching can lead to discomfort due to skin shear and pressure points, which is also the common cause of skin problems in older patients.

The present invention provides an improved fabric which addresses all of the problems previously outlined by knitting together two yarn types, at least one yarn type being an elastomeric or hyper-elastic yarn. In one embodiment, the first yarn type is comprised of a blend of natural and synthetic fibers, preferably a blend of cotton and polyester (hereinafter "poly-cotton"), and the other yarn is comprised of an elastomeric or hyper-elastic fiber such as spandex. This unique blend of knitted poly-cotton and elastomeric yarns creates a knitted fabric having increased shape retention, versatility, and an increased useful life over that of the conventional or traditionally knitted or woven fabric sheets. The elastomeric yarn allows the fabric to stretch more than traditional poly-cotton sheets. This increased stretching ability allows for easier installation of the fitted sheets on the mattress and allows the creation of one size of fitted sheet to fit all normal sized health care mattresses, with or without foam comfort overlays. The elastomeric yarn also allows the sheets to adhere better to the mattress. The elastomeric yarn gives the sheets the continued resilience to attempt to "pull" the fabric back into its resting shape even when adhered to the mattress. Further, the elastomeric yarn and poly-cotton yarn blend creates a more resilient fabric, which is resistant to snagging, fiber fatigue, pinholing, and which increases the useful life of the fabric. Further, the elasticity of the present invention allows the sheet to "give" with a patient when the patient is repositioning. Likewise, the elasticity of the sheets allows them to stay taut when the bed is raised or lowered, thereby reducing the occurrence of "bunching up" under the patient. This reduced bunching effect in turn promotes better skin care by reducing skin shear and pressure points.

While the preferred embodiment of this invention addresses problems most associated with fitted or contoured sheets, it is recognized that other products such as crib sheets, pillow cases, stretcher sheets, flat sheets, fitted flat sheets, and sheets for sale to the retail market, may be created from this inventive fabric.

SUMMARY OF THE INVENTION

The present invention solves many problems present in the prior art by providing a knitted fabric comprised of two yarn types wherein at least one yarn type is made of an elastomeric fiber and the other yarn type is made of a substantially non-elastic fiber. In the preferred embodiment, one yarn type is a blend of polyester and cotton and the other yarn type is spandex. This overall blend of spandex and poly-cotton fibers creates a knitted fabric having resilience, elasticity and versatility beyond that of a traditional poly-cotton blend fabric. This knitted fabric can then be used to produce sheeting materials, such as fitted contour sheets, which retain shape better, are more easily handled, and have a greater life that standard poly-cotton blend sheets.

Accordingly, it is the principal object of the present invention to provide a fabric which, when made into fitted bed sheets, adheres to a mattress and does not easily pop off when the head or foot end of a mattress is raised or lowered.

Another object of the present invention is to provide a fabric which can be made into a single size fitted sheet that fits all normal health care mattresses, with or without foam comfort overlays.

A further objective of the present invention is to provide a fabric which is resistant to snagging, fiber fatigue, and pinholing, which in turn increases the useful life of a sheet, crib sheet, pillowcase, stretcher sheet, or fitted contour sheet made of the fabric.

An additional object of the present invention is to provide a fabric which, when made into bed sheets and used in an institutional setting, "gives" with patients' movements when repositioning and stays taut when used as a sheet when the bed is raised or lowered. The ability of the sheets to give and stay taut promotes especially good skin care, and thereby reduces skin sheer and pressure points, which are the most common causes of skin problems in older patients.

These and other objects and advantages of the present invention will be clarified in the following description of the preferred embodiment in connection with the drawings, the disclosure and the appended claims, wherein like reference numerals represent like elements throughout.

DESCRIPTION OF THE PREFERRED EMBODIMENTS

Figure 1:
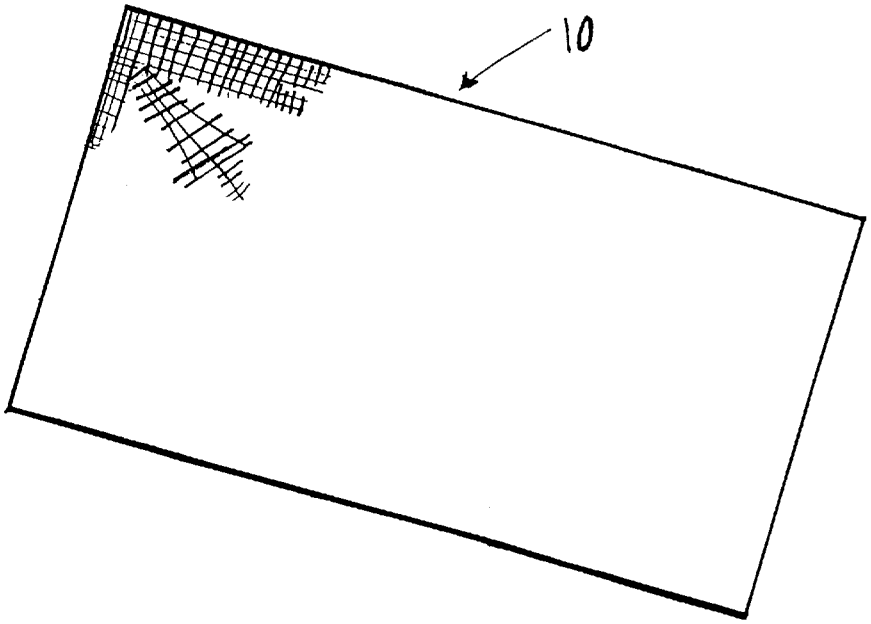
FIG. 1 is an isometric view of the knitted fabric with the central portion thereof broken away.
Figure 2:
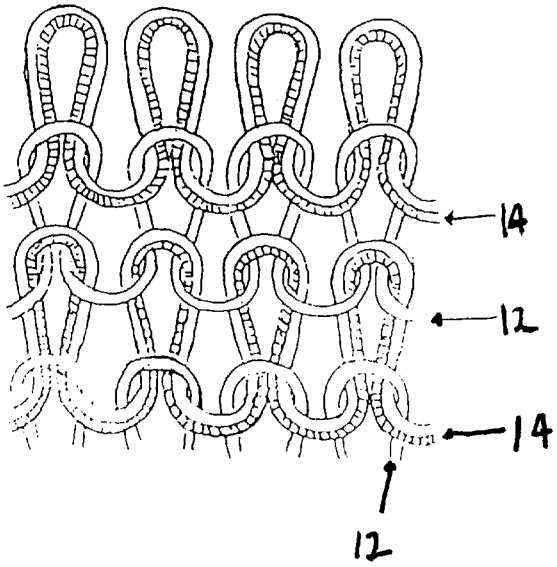
FIG. 2 is an enlarged fragmentary plan view particularly illustrating the elastomeric yarn and poly cotton yarn strands of the sheeting material.

Referring now to the drawings, the knitted fabric 10 of the present invention is illustrated in FIGS. 1 & 2. Although the present invention is directed toward the use of the knitted fabric 10 for bed sheets, and in particular contour fitted bed sheets designed specifically for institutions, it is recognized that the knitted fabric 10 may also be used to make flat sheets, fitted-flat sheets, crib sheets, pillowcases, stretcher sheets, sheets for sale in the retail market, and for the manufacturing of other textiles.

In general, the knitted fabric 10 of the preferred embodiment comprises a knitted material having a yarn strand 12, made of a blend of natural and synthetic fibers, and an elastomeric strand or hyper-elastic yarn 14. The yarn strand 12 is knitted together with the elastomeric strand 14 as illustrated in FIG. 2 to created a single piece of textile or knitted fabric 10.

The novelty of the knitted sheet 10 lies in the fiber content and combination of the two strands of yarn 12 and 14. As seen in FIG. 1, the yarn strand 12 and the elastomeric strand 14 are knitted together to form a single jersey fabric which produces, in one embodiment, a finished sheet measuring approximately 34"×71"×14" and weighing between 13 and 30 ounces depending on the over all fabric blend of the elastomeric strand 14 and the yarn strand 12.

Typically, the yarn strand 12 contains approximately 40% natural fiber and 60% synthetic material to 60% natural fiber and 40% synthetic fiber. Although any suitable synthetic material may be used in the yarn strand 12, it is preferred that the synthetic material be polyester. Likewise, it is preferred that the natural material be a combed cotton, although any suitable natural material such as wool or silk may be used as the yarn strand 12. Thus, the yarn strand 12 is comprised preferably a poly-cotton blend.

The elastomeric strand 14 of the knitted material may be comprised of any elastic textile fiber, however, it is preferred that the material be made of the elastomeric textile fiber known as spandex. Therefore, in the preferred embodiment, the knitted fabric 10 comprises a blend of poly-cotton yarn and spandex.

As seen in FIG. 2, the fabric is knitted so that there is a 1:1 ratio of elastomeric yarn 14 to poly-cotton yarn 12. While the ratio of elastomeric strands 14 to yarn strands 12 is 1:1, the weight and percentage blend of the poly-cotton yarn to elastomeric yarn is not necessarily a 50/50 ratio. The blend of a finished sheet ranges from 99.9% poly-cotton and 0.01% elastomeric material to 90% poly-cotton and 10% elastomeric material. Accordingly, depending upon the percentage blend of elastomeric yarn 14, the weight of a finished 34"×71"×14" sheet can range from 13 ounces to 30 ounces. Because the fabric is knitted with a 1:1 ratio of elastomeric yarn to poly-cotton yarn, the variation between fabric weights and blends are made possible by varying the size of the yarn strand and the denier of the elastomeric strand.

While the contents of the yarn strand 12 may range from approximately 40% natural fiber and 60% synthetic material to 60% natural fiber and 40% synthetic fiber, it is preferred that the yarn strand 12 be of a size 32/single and made of an intimate blend of 58% combed cotton and 42% polyester to 60% combed cotton and 40% polyester. Preferably, the elastomeric yarn is a size 40 denier. This combination of the size 32/single yarn strand and 40 denier elastomeric material produces a 34"×71"×14" finished sheet weighing approximately 23.5 ounces that has an overall fabric blend of 55% cotton, 41% polyester, and 4% elastomeric material.

As discussed above, the weight and blend of the fabric can be easily altered by increasing or decreasing the denier size of the elastomeric strand, increasing or decreasing the size of the yarn strand or increasing or decreasing both the size of the elastomeric strand and the yarn strand. For example, one can increase the weight of the finished sheet and increase the percentage of elastomeric material in the overall fabric blend, by using a larger denier of elastomeric material. It is recommended that overall fabric blends comprise yarn sizes ranging between size 10/single and size 45/single of poly-cotton yarn and ranging between a size 10 denier and size 60 denier elastomeric yarn.

To manufacture the knitted fabric 10 of the present invention, one may use a standard knitted fabric machine such as a Fukahara Model FXC-3S. To obtain a 1:1 ratio of poly-cotton yarn to elastomeric yarn, the machine is fitted with special feeders such as the Meminger-Iro feeders. These feeders pass the spandex or elastomeric yarn to the knitting bed of the knitting machine. These special feeders are then used in an alternating fashion so that the 1:1 ratio of elastomeric yarn to poly-cotton yarn is feed into the knitting needles.

In a second embodiment of the present invention, the knitted fabric 10 is constructed the same as the knitted fabric 10 of the preferred embodiment except the yarn strand 12 is made entirely of natural fibers, preferably combed cotton, but could also comprise silk, wool or other like substances. No synthetic fibers are used in the yarn strand 12. Therefore, the overall knitted fabric comprises a blend of combed cotton and elastomeric material.

In yet a third embodiment of the present invention, the knitted fabric 10 is again constructed the same as the knitted fabric 10 of the preferred embodiment except that the yarn strand 12 is made entirely of synthetic fibers, preferably polyester. No natural fibers are used in the yarn strand 12 of this embodiment, and thus, the overall knitted fabric comprises a blend of polyester elastomeric material.

While a preferred embodiment of the present invention has been illustrated and described, it will be apparent that changes may be made in the general construction and arrangement of the invention without departing from the scope thereof. It is therefore desired that the scope of the invention not be limited to the exact disclosure, but defined by the appended claims.

I claim:

1. A fitted bedsheet formed from a knitted fabric comprising:

a first yarn strand comprising poly-cotton fiber having a fiber content of at least 55% natural cotton material;

a second yarn strand comprising Spandex; and said first and said second yarn strands being knitted together in an overall resulting fabric blend comprising a range of 90–99.9 weight percent (%) of said first yarn strand, and a range of 0.01–10% of said second yarn strand, and then sewn in the form of a fitted bedsheet.

2. A bedsheet formed from a knitted fabric as set forth in claim 1 wherein said at least first yarn strand comprises at least forty (40%) percent polyester.

3. A bedsheet formed from a knitted fabric as set forth in claim 1 wherein said at least first yarn strand contains a blend of approximately fifty-eight (58%) combed cotton and approximately forty-two (42%) percent polyester.

4. A bedsheet formed from a knitted fabric as set forth in claim 1 wherein said at least first yarn strand is in the range of size 10/single and 45/single.

5. A bedsheet formed from a knitted fabric as set forth in claim 4 wherein said at least first yarn strand is size 32/single.

6. A knitted fabric as set forth in claim 1 wherein said at least second yarn strand is in the range of size 10 denier and 60 denier.

7. A knitted fabric as set forth in claim 1 wherein said at least second yarn strand is size 40 denier.

8. A knitted fabric as set forth in claim 1 wherein said at least first yarn strand and said at least second yarn strand are knitted together in a 1:1 ratio.

* * * * *